US006672260B1

(12) United States Patent
Sun

(10) Patent No.: US 6,672,260 B1
(45) Date of Patent: Jan. 6, 2004

(54) STEAM GENERATOR TUBE SUPPORT PLATES WITH SLOTTED DISC SPRINGS

(75) Inventor: Nansheng Sun, Cambridge (CA)

(73) Assignee: Babcock & Wilcox Canada Ltd., Cambridge (CA)

( * ) Notice: Subject to any disclaimer, the term of this patent is extended or adjusted under 35 U.S.C. 154(b) by 0 days.

(21) Appl. No.: 10/397,910

(22) Filed: Mar. 26, 2003

(51) Int. Cl.[7] ..... F22B 37/24
(52) U.S. Cl. ..... 122/510; 122/511; 248/68.1
(58) Field of Search ..... 122/510, 511, 122/493; 376/462; 110/322, 324, 325; 248/62, 68.1

(56) References Cited

U.S. PATENT DOCUMENTS 4,036,289 A * 7/1977 Cheng et al. ..... 165/82
4,120,350 A 10/1978 Norton
4,786,461 A 11/1988 Veronesi et al.
4,875,712 A 10/1989 Oda et al.
4,961,402 A * 10/1990 Delsol ..... 122/510
5,181,561 A 1/1993 Ayers et al.
5,211,908 A * 5/1993 Verdier ..... 376/442
6,006,702 A * 12/1999 Harth et al. ..... 122/511
6,498,827 B1 12/2002 Klarner

* cited by examiner

*Primary Examiner*—Gregory Wilson
(74) *Attorney, Agent, or Firm*—Kathryn W. Grant; Eric Marich

(57) ABSTRACT

An improved support for a tube bundle of a nuclear steam generator has a pair of plates separated by spacers and holding slotted disc springs used to mount tubes through tube holes of the pair of plates. The slotted disc springs deform upon installation and substantially eliminate tube vibration during use, thereby extending the useful life of the tubes. At the same time, the springs limit the pressure drop between sides of the support and enhance the heat transfer from the tubes.

14 Claims, 2 Drawing Sheets

STEAM GENERATOR TUBE SUPPORT PLATES WITH SLOTTED DISC SPRINGS

FIELD AND BACKGROUND OF INVENTION

The present invention relates generally to the field of nuclear power generators and in particular to a new and useful device for supporting heat transfer tubes in an array in a steam generator of a nuclear plant.

Pressurized water vapor generators or heat exchangers, associated with nuclear power stations and which transfer the reactor produced heat from the primary coolant to the secondary coolant that drives the plant turbines may be as long as 75 feet and have an outside diameter of about 12 feet. Within one of these heat exchangers, straight tubes through which the primary coolant flows may be no more than ⅝ inch in outside diameter, but have an effective length of as long as 52 feet between the tube-end mountings and the imposing faces of the tube sheets. Typically, there may be a bundle of more than 15,000 tubes in one of these heat exchangers. It is clear that there is a need to provide structural support for these tubes in the span between the tube sheet faces to ensure tube separation, adequate rigidity and the like.

U.S. Pat. No. 6,498,827 to Klarner, assigned to Babcock & Wilcox Canada, Ltd. and the entirety of which is hereby incorporated by reference, describes an hour-glassed, broached tube support plate (HBTSP) for use supporting these primary coolant tubes in tube bundles. The plate in the prior application supports and aligns the tubes, and minimizes deposit buildup, while providing gaps for reducing pressure drops across the plate, among other benefits.

Using the HBTSP of the prior application typically results in a tube-to-support gap between the tubes and the support holes through the HBTSP. The tube-to-support gap is in addition to the planned gap between the tube and support hole opening for relieving pressure drop differences. The tube-to-support gap is caused by tolerances of manufacture and is required for assembly of the tube bundles.

In use, the flow of steam and water through the tubes induces vibrations in the tube. The vibration may not be effectively restrained because of the tube-to-support gap. Continual vibration will result in fretting and other vibration damage and reduce the life expectancy of the tube considerably. The small tube-to-support gap also provides a limit flow area.

An HBTSP is expensive to manufacture because of the number of holes and the preferred cross-sectional shape, with three or four recesses and a corresponding number of contact or protruding members in each support hole. Complex and expensive broaching machines and tools are needed to make the plates.

A less expensive and simpler tube support plate in which the vibrations can be eliminated is very desirable.

SUMMARY OF INVENTION

It is an object of the present invention to provide a support plate for nuclear steam generator tubes which eliminates vibrations in the tubes during use.

It is a further object of the invention to provide a tube support plate which is more easily and economically manufactured than presently known support plates, while maintaining the benefits of the known support plates.

Accordingly, a support for a tube bundle is provided having upper and lower plates with circular opening through holes for a plurality of tubes, and slotted disc springs mounted between the upper and lower plates in each through hole for supporting and contacting a tube inserted in the through hole. The upper and lower plates are bolted together and may be separated by spacing washers. The slotted disc springs each have a frusto-conical shape, with a center opening through which one of the tubes of the tube bundle can be inserted.

The slotted disc springs provide gaps for reducing pressure drops between sides of the support, while having deformable direct contact with the tube sides, which reduces or eliminates tube vibration. The support with slotted disc springs provides the same benefits as known supports, while also reducing stress on the tubes in certain conditions, requiring less complex tooling and manufacture, and thereby the manufacturing cost. By reducing the vibrations in the tubes during use, the supports also help extend the useful life of the tubes in the bundle, and the springs tend to act as fins and enhance the heat transfer effect.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
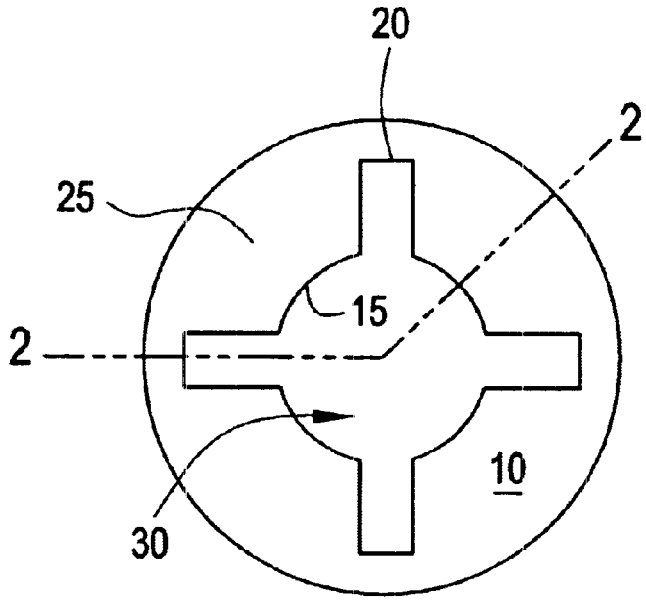
FIG. 1 is a top plan view of a slotted disc (Belleville) spring used in the support of the invention.
Figure 2:
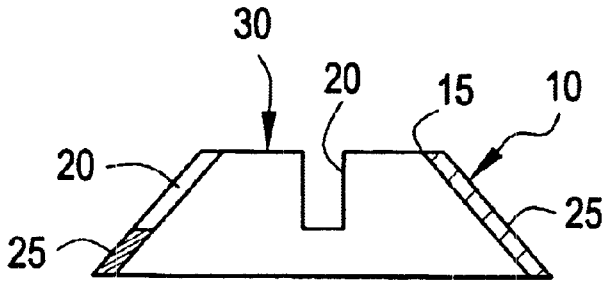
FIG. 2 is a sectional side view of the spring taken along line 2—2 of FIG. 1.

Referring now to the drawings, in which like reference numerals are used to refer to the same or similar elements, FIGS. 1 and 2 illustrate a slotted disc, or Belleville-type, spring 10 used to support tubes 50 (shown in FIG. 3) in a tube bundle of a nuclear steam generator. As shown, the slotted disc spring 10 has a center opening 30 formed by tabs 15 and slots 20 around the circumference. The slots 20 permit the tabs 15 to bend or deform, giving the spring 10 its intended effect. The side walls 25 of the spring 10 are initially formed conical, so that the slotted disc spring 10 has a frusto-conical appearance in its normal state prior to installation.

Figure 3:
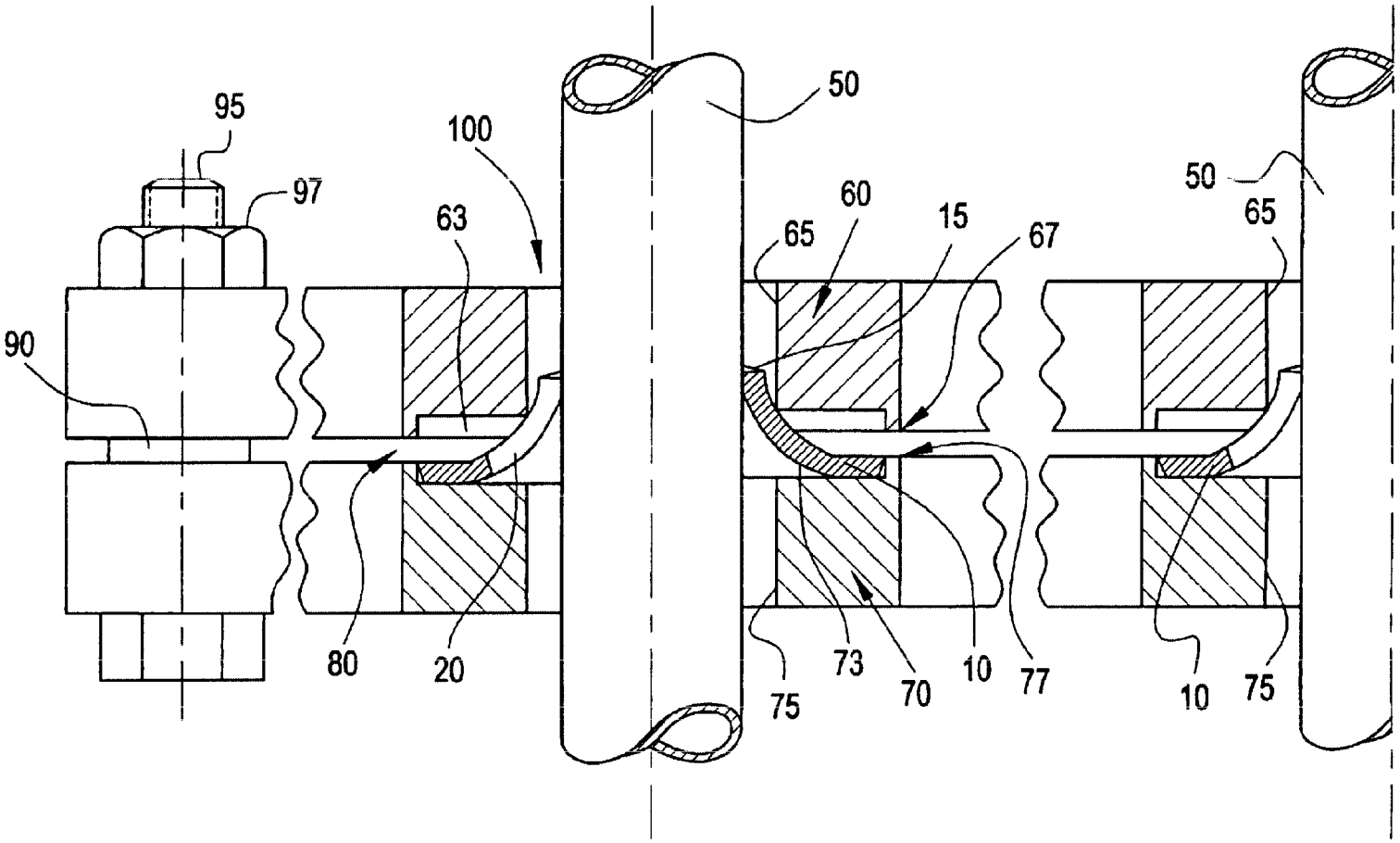
FIG. 3 is a partial sectional side elevation view of a tube support of the invention and tubes.

FIG. 3 shows how the slotted disc springs 10 are used to support tubes 50 in a manner which permits their installation, while limiting vibration in the tubes 50 during use.

Upper and lower plates 60, 70 are provided which are substantially mirror images of each other on their facing sides 67, 77. Each of the plates 60, 70 has a plurality of tube holes 65, 75 bored through the respective plate 60, 70. The tube holes 65, 75 are arranged to align with each other when the plates 60, 70 are joined as shown. The tube holes 65, 75 have a larger diameter than the outside diameter of the tubes 50 being supported, so that a gap is formed between the sides of the tube holes 65, 75 and the outer wall of tubes 50.

The facing sides 67, 77 of the support plates 60, 70 each have a small annular recess 63, 73 adjacent the tube holes 65, 75 for receiving a slotted disc spring 10. The support plates 60, 70 are joined to have a space 80 between them as well, as described below. The slotted disc springs 10 are held in the recesses 63, 73, with the spring 10 center opening 30 being substantially coaxial with the tube holes 65, 75. When the support plates 60, 70 are joined, the springs 10 will be flattened slightly from their original shape, as the facing sides 67, 77 converge on the springs 10.

The support plates 60, 70 are preferably joined using bolt 95 and nut 97, with a spacer washer 90 interposed between the facing sides 67, 77 of the plates 60, 70. The bolts 95 are inserted through aligned bolt holes in the plates 60, 70 and tightened using nuts 97. Using appropriate bolt-preloading, the tabs 15 of the slotted disc springs 10 are elastically deformed until they touch the adjacent tube inserted though the center opening 30. The side walls 25 of the slotted disc springs 10 will tend to take on a concave shape when they are deformed. The washer 90 prevents the springs from overloading.

The slotted disc springs 10 used in the support 100 are preferably commercially available Belleville type springs made of INCONEL alloy or stainless steel. Other slotted disc springs having similar characteristics can be used as well. The springs should be capable of resisting the heat and moisture conditions inside a steam generator in the same manner as stainless steel or INCONEL alloy.

The springs 10 are not deformed initially during installation until the bolt pre-load is applied. This permits suitable clearance for the tubes 50 to ensure ease of installation. Applying the bolt pre-load deforms the tabs 15 at the sides of the tubes 50, thereby restraining them and ensuring contact between the support 100 and tubes 50. The amount of restraint force applied to the tubes 50 by the bolt pre-load is controllable, and, more importantly, determinable using Finite Element Methods.

Further, the slots 20 in the slotted disc springs 10 provide a relatively larger flow area than known supports. As a result, the pressure drop is reduced further than previously possible, and as well, water flow through the tube plates is smoothed and less turbulent. The larger flow area also results in increased space for sludge loading before local flow channels are blocked.

The tabs 15 contacting the sides of the tubes 50 help to prevent vibration in the tubes 50 during use, as they are held relatively rigidly compared to prior designs. The reduction or elimination of vibration eliminates damage from fretting caused by vibration, and thus extends the life of the tubes 50. The tabs 15 also act as heat fins, thereby improving the heat transfer qualities of the tube bundle where the support 100 is used.

The allowance for rotational interference between the tubes 50 and hole 65, 75 is increased by the support 100. An entrance taper formed in the lower plate 70 can be provided to guide the tubes 50 during installation. The springs 10 provide reduced stress under conditions of Level D loading due to larger deflection provided by the springs over prior tube support contacts.

The cost of manufacturing and installing tube bundles using the support 100 is significantly reduced, because tooling the tube holes 65, 75 in the plates is much simpler. The tube holes 65, 75 are simply straight cylindrical bores, without complex side wall geometry to machine. Special broaching machines and tools are not required. At the same time, the support 100 does not change the overall assembly of a conventional steam generator, so it is easily adaptable to new installations or replacements.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles.

I claim:

1. A support for a tube bundle of a nuclear steam generator having a plurality of tubes forming the tube bundle, the support comprising:

an upper support plate having a plurality of cylindrical upper tube holes therethrough;

a lower support plate having a corresponding plurality of cylindrical lower tube holes therethrough, the upper and lower support plates being arranged facing each other to form aligned pairs of upper and lower tube holes;

a plurality of slotted disc springs arranged interposed between the upper and lower support plates coaxial with each pair of aligned upper and lower tube holes, each spring for receiving one of the tubes in the tube bundle; and means for joining the upper and lower support plates together in fixed relation.

2. The support of claim 1, wherein the slotted disc springs each have a plurality of tabs and slots defining a center opening, the center opening for receiving the one of the tubes in the tube bundle and the plurality of tabs for contacting the tube.

3. The support of claim 1, wherein the slotted disc springs are each made of one of INCONEL alloy and stainless steel.

4. The support of claim 1, wherein the means for joining comprises a plurality of bolt fasteners passing through each of the upper and lower plates and secured by threaded nuts.

5. The support of claim 1, further comprising annular recesses in each of the upper and lower support plates around the tube holes in the sides of the upper and lower support plates arranged facing each other.

6. A support for a tube bundle of a nuclear steam generator having a plurality of primary coolant tubes forming the tube bundle, the support comprising:

upper and lower support plates arranged each having a facing side oriented facing the other plate facing side, each support plate having a plurality of cylindrical tube holes formed therethrough and aligned with the tube holes of the other support plate, and a plurality of annular recesses formed in the upper and lower facing sides around each of the tube holes;

a plurality of slotted disc springs, each spring being held within one of the recesses between the facing sides of the upper and lower support plates, each spring having a central opening for receiving one of the plurality of primary coolant tubes inserted through the corresponding aligned tube holes; and means for joining the upper and lower support plates together under a controllable load condition.

7. The support of claim 6, wherein the slotted disc springs each have a plurality of tabs and slots defining a center opening, the center opening for receiving the one of the tubes in the tube bundle and the plurality of tabs for contacting the tube.

8. The support of claim 6, wherein the slotted disc springs are each made of one of INCONEL alloy and stainless steel.

9. The support of claim 6, wherein the means for joining comprises a plurality of bolt fasteners passing through each of the upper and lower plates and secured by threaded nuts.

10. A method for supporting a plurality of tubes forming a tube bundle of a nuclear steam generator, comprising:

providing an upper support plate having a plurality of upper tube holes therethrough;

providing a lower support plate having a corresponding plurality of lower tube holes therethough;

providing a plurality of slotted disc springs;

arranging the upper and lower support plates to face each other with the pluralities of upper and lower tube holes aligned to form pairs of tube holes;

interposing one of the plurality of slotted disc springs between each pair of tube holes;

inserting one of the plurality of tubes through each of the pairs of tube holes and slotted disc springs; and joining the upper and lower support plates together to pre-load the plurality of slotted disc springs and deform the slotted disc springs around each of the plurality of tubes.

11. The method of claim 10, wherein the plurality of slotted disc springs are each provided with a plurality of tabs and slots defining a center opening, the center opening for receiving the one of the tubes in the tube bundle and the plurality of tabs for contacting the tube.

12. The method of claim 10, wherein the slotted disc springs are each made of one of INCONEL alloy and stainless steel.

13. The method of claim 10, wherein the means for joining comprises a plurality of bolt fasteners passing through each of the upper and lower plates and secured by threaded nuts.

14. The method of claim 10, further comprising providing annular recesses in each of the upper and lower support plates around the tube holes in the sides of the upper and lower support plates arranged facing each other.

* * * * *